US005760665A

United States Patent [19]

Turunen et al.

[11] Patent Number: 5,760,665

[45] Date of Patent: Jun. 2, 1998

[54] STRIPLINE RESONATOR STRUCTURE FORMED ON UPPER AND LATERAL SURFACES OF SUBSTRATE PROJECTIONS

[75] Inventors: Aimo Turunen; Heli Jantunen, both of Oulu, Finland

[73] Assignee: ADC Solitra Oy, Kempele, Finland

[21] Appl. No.: 635,960

[22] PCT Filed: Nov. 1, 1994

[86] PCT No.: PCT/FI94/00490

§ 371 Date: Apr. 29, 1996

§ 102(e) Date: Apr. 29, 1996

[87] PCT Pub. No.: WO95/12904

PCT Pub. Date: May 11, 1995

[30] Foreign Application Priority Data

Nov. 1, 1993 [FI] Finland ..... 934827

[51] Int. Cl.[6] ..... H01P 1/203; H01P 7/08

[52] U.S. Cl. ..... 333/204; 333/219

[58] Field of Search ..... 333/202, 202 DB, 333/203, 204, 219

[56] References Cited

U.S. PATENT DOCUMENTS 4,757,286 7/1988 Konishi et al. ..... 333/204

5,124,675 6/1992 Komazaki et al. ..... 333/204

5,160,905 11/1992 Hoang ..... 333/204

FOREIGN PATENT DOCUMENTS 0144601 6/1988 Japan ..... 333/204

3234102 10/1991 Japan ..... 333/203

6140802 5/1994 Japan ..... 333/204

OTHER PUBLICATIONS

Patent Abstracts of Japan, vol. 10, No. 279, E-439, Abstract of JP 61-100002 (Matsushita Electric Inc. Co. Ltd.) 19 May 1986.

*Primary Examiner*—Benny Lee

*Assistant Examiner*—Barbara Summons

*Attorney, Agent, or Firm*—Andrus, Sceales, Starke & Sawall

[57] ABSTRACT

The invention relates to a stripline resonator structure comprising a substrate (2) and one or more stripline patterns (3 to 7) formed on the substrate as a conductive coating. The stripline patterns (3 to 7) are formed as the conductive coating of projections protruding from the actual substrate material and being made of the substrate material.

15 Claims, 2 Drawing Sheets

STRIPLINE RESONATOR STRUCTURE FORMED ON UPPER AND LATERAL SURFACES OF SUBSTRATE PROJECTIONS

BACKGROUND OF THE INVENTION

The invention relates to a stripline resonator structure comprising a substrate and one or more stripline patterns formed on the substrate as a conductive coating.

Stripline resonators are low planar resonators. They are used in the implementation of high-frequency circuits, e.g. in mobile phones or their base stations. Stripline resonators can be used e.g. at the output stages of mobile radio amplifiers as matching circuits and filtering circuits. Stripline circuits are used generally already at frequencies of 1.8 GHz. The stripline patterns of stripline resonators are matched with each other in such a way that the resonator structure will provide a frequency response of a desired kind within the frequency range. At simplest, the resonator structure may be formed by a single stripline pattern. This kind of resonator can be used e.g. with a voltage-controlled oscillator (VCO), where the stripline resonator determines the oscillating frequency of the oscillator. In the case of a duplex filter, stripline resonators usually comprise 3 to 6 stripline patterns or 6 to 12 stripline patterns. The properties of the stripline resonator, that is, in practice, the resonance frequency and specific impedance, depend on the width and length of the stripline pattern, the distance between adjacent stripline patterns, the thickness of the substrate, and the dielectric constant of the substrate.

The substrate of stripline resonators is of a dielectric material, such as a ceramic material, e.g. Zirconium tin-titanate having a dielectric constant of about 36 units. Stripline patterns are formed on the substrate by conductive metallization, such as a silver coating. Stripline resonators are used mainly due to the fact that they are easy to produce and low in structure. By the use of the stripline resonator, a desired resonator structure can be made lower, and, in any case, it is easier to produce than with another resonator type, i.e. coaxial resonator, which, however, provides a higher quality factor (Q factor) than stripline resonators.

In conventional stripline resonators known from the prior art, stripline patterns are formed on an even substrate as thin planar strip-like patterns. In the prior art stripline resonators, the stripline pattern is extremely thin, frequently having a thickness as small as a few tens of micrometers. In practice, the stripline pattern, i.e. the conductive coating, is thus a two-dimensional planar pattern. The biggest disadvantage of the prior art stripline resonators is that they have a low Q factor as compared with Q factors attainable by coaxial resonators, for instance. The low Q factor of stripline resonators is due to line losses occurring in stripline patterns. Other problems associated with prior art stripline resonators implemented by planar two-dimensional stripline patterns concern the electric matching, or coupling, between adjacent stripline patterns, and the provision of external coupling. In prior art solutions, coupling between adjacent stripline patterns, i.e. individual resonators, has been adjusted by varying the distance between the adjacent stripline patterns, which, of course, has increased the physical size of the stripline resonator as an individual component.

Attempts have been made to improve the properties of stripline resonators by shaping the stripline patterns of the stripline resonator structure so as to make them three-dimensional to some extent, thus operationally imitating the coaxial resonator allowing a higher Q factor. An example of such a structure is a resonator structure where semi-circular arched recesses are formed in a planar substrate, the stripline coating being formed on the surface of the recesses. However, the Applicant has observed that this solution does not provide a sufficiently suitable structure for all uses as far as the ease of production and the imitation of the operation of the coaxial resonator are concerned.

SUMMARY OF THE INVENTION

The object of the present invention is to provide a new stripline resonator structure which avoids the problems associated with the prior art solutions.

This object is achieved by a stripline resonator structure according to the invention, which is characterized in that the stripline patterns are formed as the conductive coating of projections protruding from the actual substrate material, the projections being made of the substrate material, in such a manner that the conductive coating forming the stripline pattern is provided both on the upper surface of the projection and on one or more lateral surfaces of the projection.

The stripline resonator structure according to the invention is based on the idea of aiming at a three-dimensional structure easy to produce and imitating the operation of the coaxial resonator.

The stripline resonator structure according to the invention offers a number of advantages. The new stripline resonator provides a resonator structure that is not only low and easy to produce but also has a higher Q factor. The Applicant has observed that the electromagnetic field operates in this new solution to a relatively great extent in the same way as in the proper coaxial resonator. The new structure allows coupling between adjacent stripline patterns to be adjusted without increasing the size of the resonator. In addition, external coupling to the resonator structure, that is, in practice, to the outermost stripline patterns, can be made without galvanic contact by utilizing the electro-magnetic field.

BRIEF DESCRIPTION OF THE DRAWING

In the following the invention will be described more fully with reference to the attached drawings, where.

DETAILED DESCRIPTION OF THE PREFERRED EMBODIMENTS

Figure 1:
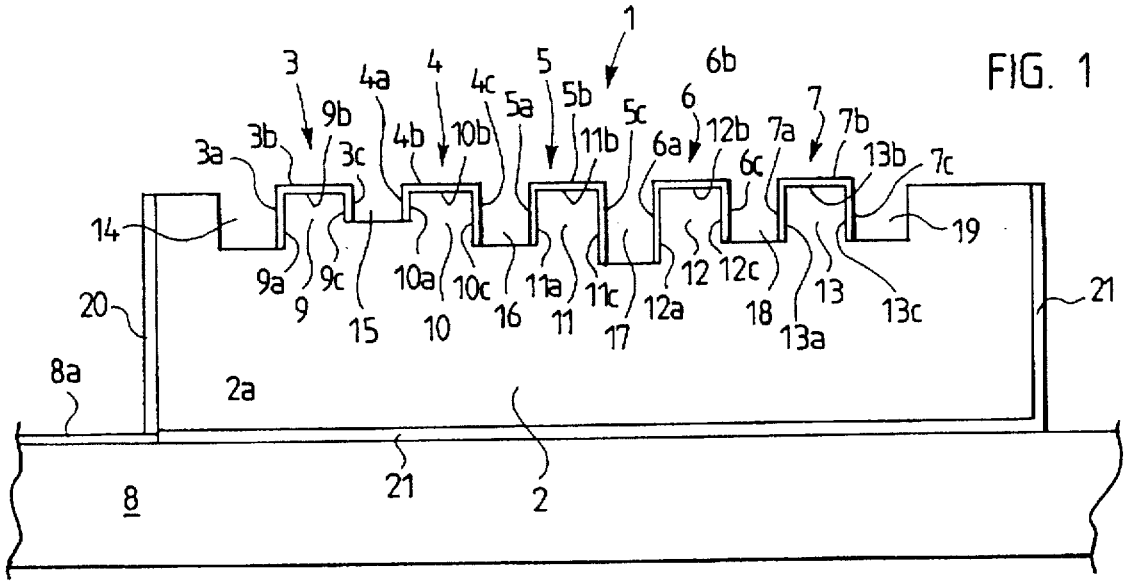
FIG. 1 is an end view of the stripline resonator structure.
Figure 2:
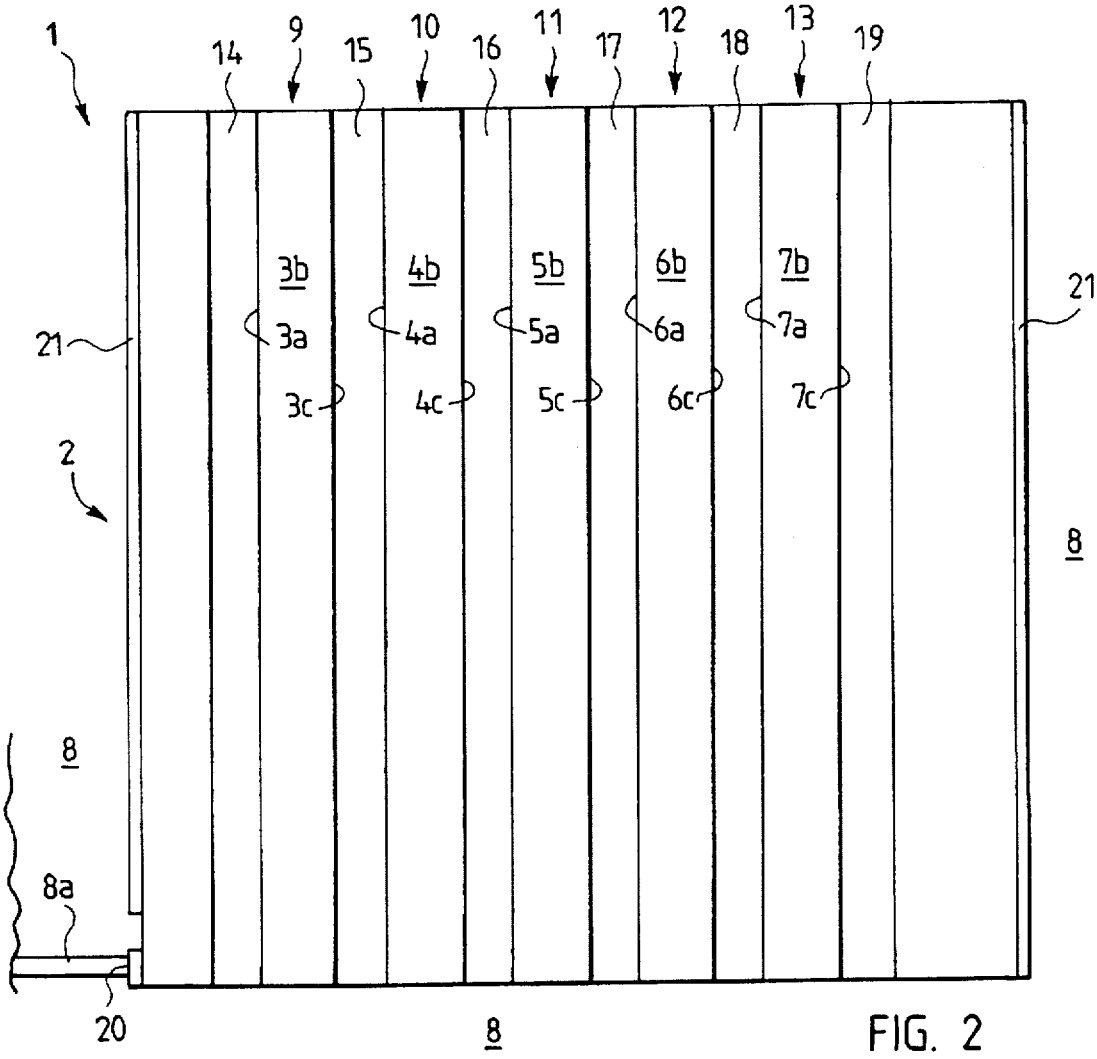
FIG. 2 is a top view of the stripline resonator structure.

Referring to FIGS. 1 and 2, the stripline resonator structure 1 comprises a substrate 2 and one or more (five in FIGS. 1 and 2) stripline patterns 3 to 7, which are formed as a conductive coating on the substrate 2. The substrate 2 is preferably of a ceramic dielectric material, such as Zirconium tin-titanate. The stripline resonator 1 is mounted as a component on a printed circuit board 8.

The substrate 2 comprises projections 9 to 13, the number of which is equal to or greater than that of the stripline patterns 3 to 7. The projections 9 to 13 protrude from the actual substrate material, i.e. from the substrate 2, and are made of the same substrate material and thus form part of the material body of the actual substrate 2 below the projection. According to the invention, the stripline patterns 3 to 7 are formed as a conductive coating on the projections 9 to 13 protruding from the actual substrate 2 and made of the substrate material. Positioned in this way, the stripline patterns 3 to 7 extend in the direction of height of the projections 9 to 13. In the preferred embodiment shown in FIGS. 1 and 2, the projections 9 to 13, on which the stripline patterns 3 to 7 are formed, comprise three substantially planar surfaces 9*a* to 13*a*, 9*b* to 13*b* and 9*c* to 13*c* positioned at an angle with respect to each other, the stripline patterns 3 to 7 extending on to all the three planar surfaces. Correspondingly, the stripline patterns 3 to 7 thus comprise three substantially planar surfaces 3*a* to 7*a*, 3*b* to 7*b* and 3*c* to 7*c* positioned at an angle with respect to each other.

It is to be seen from the embodiment shown in FIGS. 1 and 2 that the two outermost planar surfaces of the three planar surfaces 9*a* to 13*a*, 9*b* to 13*b*, and 9*c* to 13*c* of the projections 9 to 13, such as the surfaces 9*a* and 9*c*, are parallel to each other. Correspondingly, the outermost surfaces of the other projections 10 to 13, such as the surfaces 13*a* and 13*c* in the projection 13, are parallel to each other. Around the projections 9 to 13, the stripline resonator further comprises areas 14 to 19 free of the substrate material. In practice, the areas 14 to 19 free of the substrate material are grooves formed in the even substrate. The projections 9 to 13, which are made of the substrate material 2 and protrude from the actual substrate material 2 and on which the stripline patterns 3 to 7 are formed, are formed between the areas 14 to 19 formed in the substrate material but free of the substrate material. In this embodiment, the substrate is easy to produce, as the projections 9 to 13 can be formed e.g. by sawing or cutting grooves in the even substrate 2, in this specific case the areas 14 to 19 free of the substrate material, between which the projections 9 to 13 are positioned. Particularly the solution shown in FIGS. 1 and 2 allows easy production. This is because the outermost surfaces of the projections 9 to 13 in the figures, such as the surfaces 9*a* and 9*c*, are parallel to each other, and parallel grooves are easy to form e.g. by sawing. A further advantage is that it is easier to form the stripline patterns 3 to 7 on the projections, particularly on the outermost surfaces of the projections 9 to 13, such as the stripline patterns 3*a* and 3*c* on the surfaces 9*a* and 9*c*.

It is to be noted in this connection that the surface of the stripline resonator need not necessarily be stepped or otherwise uneven, as the grooves 14 to 19 between the projections 9 to 13 can be filled with metallization, such as silver paint, used in the formation of the stripline patterns 3 to 7 on the projections 9 to 13. Accordingly, it should be understood that the term projection does not necessarily refer to an uneven surface shape; according to the invention, the projection, such as the projections 3 to 7, is a real protruding projecting in relation to the actual substrate 2.

According to the Applicant's observations, the solution according to the invention is operative even in cases where the resonator structure comprises a single projection and a single stripline pattern, whereby a structure of several resonators can, if required, be formed by individual stripline patterns formed on their own separate substrates, even though this Kind of structure is more difficult to produce. In the preferred embodiment, in cases where there are several stripline patterns 3 to 7 and thus several projections 9 to 13, the stripline patterns 3 to 7 and thus the projections 9 to 13 are positioned on the same substrate 2, as shown in FIGS. 1 and 2.

The stripline resonator structure 1 shown in FIGS. 1 and 2 comprises a number of stripline patterns 3 to 7. The projections 9 to 13 made of the substrate material 2 and protruding from the actual substrate material 2 extend at least substantially to the same height, as is to be seen from FIG. 1. In this preferred embodiment, the substrate can be produced in the easiest way, as the formation of the grooves 14 to 19 and thus the formation of the projections 9 to 13 can be started from the planar substrate body.

The mere resonator structure 1 as such does not form an operative electric circuit, but it has to be integrated in an electric circuit or connection. This is done by external coupling of the resonator 1, which is provided through the outermost individual stripline pattern resonators of the resonator 1, such as the resonators 3 and 7. In FIGS. 1 and 2, the external coupling of the stripline resonator 1 has been done to a conductive pattern 8*a* comprised in the printed circuit board 8. As appears from FIGS. 1 and 2, the external coupling to the outermost stripline pattern 3 of the stripline resonator structure 1 has been done in the preferred embodiment by means of an electro-magnetic field between a coupling area 20 formed on the side of the stripline resonator structure and the stripline pattern 3. According to the invention, an electro-magnetic field rotates in the three-dimensional stripline resonator 1 around the stripline patterns 3 to 7, such as the outermost stripline pattern 3, in such a way that the electric field extends from the stripline pattern 3 up to the side of the resonator structure 1, whereby external coupling can be done through the coupling area located within the area covered by the electro-magnetic field According to the Applicant's observations, the strongest coupling between the coupling area 20 and the stripline pattern 3 is achieved in the preferred embodiment where the coupling area 20 is formed in the direction of height at least partly at a height at which the outermost projection 9 protruding from the substrate material and made of the substrate material is formed. In practice, this means that the coupling area 20 is formed in the direction of height in an area at which height the groove 14 adjacent to the projection 9, i.e. the area 14 free of the substrate material, is located. In another preferred embodiment, the coupling area 20 is formed, as shown in FIGS. 1 and 2, so as to extend at least substantially to the level of a lower edge 2*a* of the substrate 2 or otherwise close to the bottom of the stripline resonator component, so that the coupling area 20 can be directly utilized as a surface-mounting pin when the resonator component 1 is placed on the printed circuit board. In such a case, the coupling area is supported directly to the conductive pattern 8*a* of the printed circuit board 8, which allows coupling without wire bonding.

The resonator structure 1 also comprises a protective coating 21, such as metallization. It appears particularly clearly from FIG. 2 that the coupling area 20 is separate from the protective coating 21 of the substrate 2.

As appears from FIG. 1 in particular, the dimension of the stripline pattern, such as the stripline patterns 3 to 7, in the direction of height is preferably many times greater than the thickness of the stripline pattern. In practice, this means, for instance, that the outermost parts 3*a* to 7*a* and 3*c* to 7*c* of the stripline patterns extend over a distance of e.g. 0.5 mm, in the direction of height, whereas the thickness of the stripline pattern is only a few tens or micrometers.

In one particularly advantageous embodiment, the areas 14 to 19 made in the substrate material particularly as shown in FIG. 1 and free of the substrate material, i.e. the grooves 14 to 19, are unequal in depth, which allows the dimensions of the stripline patterns 3 to 7 on the surface of the projections 9 to 13 differ from each other in the direction of height. In practice, the grooves 14 to 19 of different depths can be used for matching or interconnecting individual stripline patterns 3 to 7, i.e. individual resonator strips 3 to 7 precisely with a desired strength so that a frequency response of a desired type could be realized by the entire resonator structure 1. This new way of adjusting coupling, which takes place in the direction of the height of the structure, is particularly applicable in the low stripline resonator structures according to the invention, as, in practice, the coupling strength is determined already when the grooves 14 to 19 are being formed. Accordingly, no special measures are needed for adjusting coupling between adjacent resonator strips, such as the strips 3 and 4 or 4 and 5 or 5 and 6, as the grooves 14 to 19 are made in any case in order for the projections 9 to 13 to be formed. The only additional measure required is that the grooves 14 to 19 are provided with different depths. All of the grooves 14 to 19 need not be unequal in depth.

Figure 3:
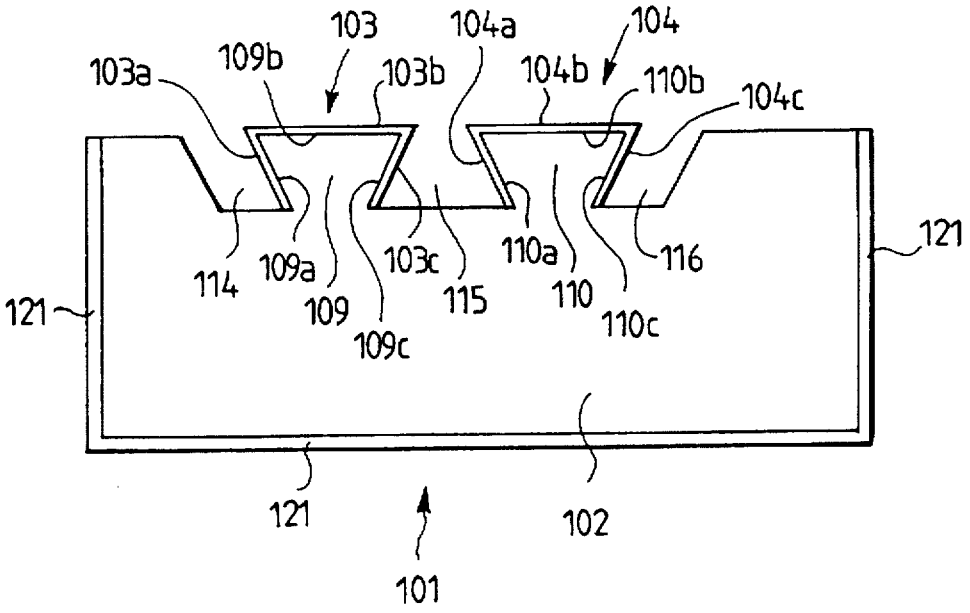
FIG. 3 is an end view of another embodiment of the stripline resonator structure.

FIG. 3 is an end view of another embodiment of the stripline resonator structure, where the projections of the substrate and thus the stripline patterns are formed in a different way than in FIGS. 1 and 2. FIG.3 shows a resonator structure 101 with a substrate 102. The resonator structure 101 shown in FIG. 3 comprises only two stripline patterns 103 and 104, and the substrate 102 in turn comprises only two projections 109 and 110, which protrude from the actual substrate 102 but form part of the material body of the actual substrate 102. In the same way as in FIG. 1, the stripline patterns 103 and 104 in FIG. 3 are formed as a conductive coating on the projections 109 and 110 protruding from the actual substrate 102 and made of the substrate material. In the same way as in FIGS. 1 and 2, the projections 109 and 110 in the embodiment shown in FIG. 3 comprise three substantially planar surfaces 109*a* to 109*c* and 110*a* to 110*c*. Correspondingly, the stripline patterns 103 and 104 comprise surfaces 103*a* to 103*c* and 104*a* to 104*c*, respectively. The stripline patterns 103 and 104 thus extend on to all of the three planar surfaces 109*a* to 109*c* and 110*a* to 110*c* in the projections 109 and 110. The resonator structure 101 thereby comprises areas 114 to 116 free of the substrate material, that is, grooves 114 to 116. One advantage of the embodiment of FIG. 3 is that the outermost two planar surfaces 109*a* and 109*c* of the three planar surfaces of the projections, such as the surfaces 109*a* to 109*c*, extend in different directions.

Correspondingly, the two outermost surfaces 110*a* and 110*c* extend in different directions. According to the Applicant's observations, the low stripline resonator structure 101 thereby functionally imitates the co-axial resonator more accurately than previously, although the formation of the grooves 114 to 116 is a slightly more laborious step than in the case of FIGS. 1 and 2. In FIG. 3, the protective coating, such as metallization, is indicated with the reference numeral 121.

In the structure according to the invention (See FIG.1 ) the conductive coating forming the stripline pattern 3 is thus provided both on the upper surface 9*b* of the projection 9 and on one or more lateral surfaces 9*a*, 9*b* of the projection 9. According to a preferred embodiment of the invention, the conductive coating forming the stripline pattern 3, at least the part of the conductive coating 3*c* provided on the lateral surface 9*c* of the projection, faces the lateral surface 10*a* of the adjacent projection 10.

According to another preferred embodiment of the invention, the conductive coating forming the strip-line pattern 3, at least the part of the coating provided on the lateral surface 9*c* of the projection, faces the lateral surface of the adjacent projection 10, said adjacent projection 10 also comprising a stripline pattern 4 the conductive coating 4*b*, 4*a* and/or 4*c* of which is provided both on the upper surface 10*b* of the projection and on the lateral surface 10*a* a and/or 10*c* of the projection.

According to yet another preferred embodiment or the invention, the conductive coating 3*a*–3*c* forming the stripline pattern 3 extends as a continuous coating from the first lateral surface 9*a* of the projection 9 through the upper surface 9*b* of the projection to the second lateral surface 9*c* of the projection.

Most preferably, all stripline patterns 3 to 7 and projections 9 to 13, not only stripline pattern 3 and projection 9, are implemented in accordance with the preferred embodiments described above, as illustrated in the accompanying figures.

Even though the invention has been described above with reference to the examples shown in the attached drawings, it is obvious that the invention is not limited to them, but it can be modified in various ways within the inventive idea disclosed in the attached claims.

We claim:

1. Stripline resonator structure comprising a substrate (2) and one or more stripline patterns (3 to 7) formed on the substrate as a conductive coating, characterized in that each of the stripline patterns (3 to 7) are formed as the conductive coating on corresponding projections protruding from the actual substrate material, the projections being made of the substrate material, in such a manner that the conductive coating forming one stripline pattern (3) is provided both on an upper surface (9*b*) of the corresponding projection (9) and on one or more lateral surfaces (9*a*, 9*b*) of the corresponding projection (9).

2. Stripline resonator structure according to claim 1, characterized in that the one or more stripline patterns further comprises at least two stripline patterns wherein the conductive coating forming the one stripline pattern (3), at least in the part of the conductive coating (3*c*) provided on one of the lateral surfaces (9*c*) of the corresponding projection, faces one of the lateral surfaces (10*a*) of an adjacent projection (10).

3. Stripline resonator structure according to claim 1, characterized in that the one or more stripline patterns further comprises at least two stripline patterns wherein the conductive coating forming the one stripline pattern (3), at least in the part of the coating provided on one of the lateral surfaces (9*c*) of the corresponding projection, faces one of the lateral surfaces of an adjacent projection (10), said adjacent projection (10) also comprising a stripline pattern (4) the conductive coating (4*b*, 4*a* and/or 4*c*) of which is provided both on an upper surface (10*b*) of the adjacent projection and on one or more of the lateral surfaces (10*a* and/or 10*c*) of the adjacent projection.

4. Stripline resonator structure according to claim 1, characterized in that the conductive coating (3*a*–3*c*) forming the one stripline pattern (3) extends as a continuous coating from a first lateral surface (9*a*) of the corresponding projection (9) through the upper surface (9*b*) of the projection to a second lateral surface (9*c*) of the projection.

5. Stripline resonator structure according to claim 1, characterized in that each of the corresponding projections (9 to 13), which protrude from the actual substrate material and are made of the substrate material and on which the one or more stripline patterns (3 to 7) are formed, are formed between areas (14 to 19) formed in the substrate material which are free of the substrate material.

6. Stripline resonator structure according to claim 1, characterized in that each of the corresponding projections (9 to 13), on which the one or more stripline patterns (3 to 7) are formed, comprise three substantially planar surfaces (9*a* to 13*a*, 9*b* to 13*b*, 9*c* to 13*c*) positioned at an angle with respect to each other, and that each of the one or more stripline patterns (3 to 7) extends on to all of the three planar surfaces of its corresponding projection.

7. Stripline resonator structure according to claim 6, characterized in that the two planar surfaces (9*a* and 9*c*, 10*a* and 10*c*, 11*a* and 11*c*, 12*a* and 12*c*, 13*a* and 13*c*, respectively) of the three planar surfaces are parallel to each other.

8. Stripline resonator structure according to claim 6, characterized in that the two outermost planar surfaces (103*a* and 103*c*, 104*a* and 104*c*, respectively) of the three planar surfaces are not parallel to each other.

9. Stripline resonator structure according to claim 5, characterized in that the one or more stripline patterns further comprises at least two stripline patterns (3 to 7), and that the areas (14 to 19) formed in the substrate material and free of the substrate material differ in depth.

10. Stripline resonator structure according to claim 5, characterized in that the one or more stripline patterns further comprises at least two stripline patterns (3 to 7), and that each of the corresponding projections (9 to 13), which are made of the substrate material and protrude from the actual substrate material, extend at least substantially to the same height.

11. Stripline resonator structure according to claim 1, characterized in that external coupling to an outermost stripline pattern (3) of the stripline resonator structure is carried out by means of an electro-magnetic field between the outermost stripline pattern (3) and a coupling area (20) formed on a side of the stripline resonator structure.

12. Stripline resonator structure according to claim 11, characterized in that the coupling area (20) is formed in the direction of height at least partly at a height at which an outermost projection (9), which protrudes from the substrate material and is made of the substrate material and which is coated by the outermost stripline pattern (3), is formed.

13. Stripline resonator structure according to claim 11, characterized in that the coupling area (20) is formed so as to extend at least substantially to the same height as a lower edge (2*a*) of the substrate (2).

14. Stripline resonator structure according to claim 1, characterized in that the dimension of the stripline patterns (3 to 7) in the direction of height is many times greater than the thickness of the stripline patterns (3 to 7).

15. Stripline resonator structure according to claim 12, characterized in that the coupling area (20) is formed so as to extend at least substantially to the same height as a lower edge (2*a*) of the substrate (2).

* * * * *